US006722997B2

(12) United States Patent
Gilmour

(10) Patent No.: US 6,722,997 B2
(45) Date of Patent: Apr. 20, 2004

(54) GOLF CUP AND FLAGPOLE ADAPTER WITH REPLACEABLE BUSHING

(75) Inventor: Alfred John Gilmour, Waterloo (CA)

(73) Assignee: Uni-Spray Systems Inc., Waterloo (CA)

( * ) Notice: Subject to any disclaimer, the term of this patent is extended or adjusted under 35 U.S.C. 154(b) by 0 days.

(21) Appl. No.: 10/139,260

(22) Filed: May 7, 2002

(65) Prior Publication Data

US 2002/0198059 A1 Dec. 26, 2002

(30) Foreign Application Priority Data

Jun. 21, 2001 (CA) ..... 2351185

(51) Int. Cl.[7] ..... A63B 57/00
(52) U.S. Cl. ..... 473/176
(58) Field of Search ..... 473/175–178

(56) References Cited

U.S. PATENT DOCUMENTS

| | | | | |
|---|---|---|---|---|
| 672,395 A | | 4/1901 | Felton | |
| 1,115,937 A | | 1/1914 | Hinckley | |
| 1,291,067 A | | 1/1919 | Michael | |
| 1,504,934 A | | 8/1924 | Brown | |
| 1,676,954 A | | 7/1928 | Kannemann | |
| 1,829,283 A | | 11/1931 | Kip | |
| 1,943,610 A | | 1/1934 | John | |
| 3,348,797 A | | 10/1967 | Turbyfill | |
| 3,732,845 A | | 5/1973 | Istre | |
| 4,290,603 A | * | 9/1981 | Barnes | 473/177 |
| 4,878,665 A | | 11/1989 | Boudreau et al. | |
| 5,351,950 A | * | 10/1994 | Frankum | 473/176 |
| 5,451,045 A | | 9/1995 | Garske | |
| 6,113,503 A | | 9/2000 | Brookman | |
| 6,478,687 B1 | * | 11/2002 | Colonello | 473/175 |

* cited by examiner

*Primary Examiner*—Mark S. Graham
(74) *Attorney, Agent, or Firm*—Riches, McKenzie & Herbert LLP

(57) ABSTRACT

A golf cup comprises a tubular housing, support members provided within the housing and defining a central bore for receiving a replaceable plastic bushing. The bushing, having an upper end and a lower end, is snugly fitted in the central bore. The upper end of the bushing member has an annular flange supported by a shoulder of the support members. The lower end of the bushing member is extended below the support members and provided with an annular groove for receiving an o-ring for holding the bushing member in a fixed position. The present invention also discloses a plastic bushing for a metal golf flagpole adapter.

16 Claims, 3 Drawing Sheets

GOLF CUP AND FLAGPOLE ADAPTER WITH REPLACEABLE BUSHING

FIELD OF THE INVENTION

The present invention relates to a golf cup and, in particular, to a golf cup with a replaceable bushing. The present invention also relates to a golf flagpole with a replaceable bushing.

BACKGROUND OF THE INVENTION

Presently golf courses around the world use various types of golf cups that fit into the holes on the greens. A few of the dimensions for these golf cups are standard. For example, the outer diameter of the golf cup, the inner diameter of golf flagpole holder, and the height of the golf cup are all standard dimensions.

In the past few years, conventional golf cups were made of plastic. More recently, conventional golf cups are being made from aluminum and other types of metal alloys as well as plastic. The cost of a metal golf cup is almost double the cost of a plastic golf cup. Some golf courses still use plastic golf cups. However, the golfers prefer a metal golf cup mainly for the reason that the metal golf cup creates a better satisfying clink sound when a golf ball hits the bottom of the metal golf cup.

Conventional golf flagpoles usually have a metal adapter at a lower end of the flagpole adapted to be inserted into a metal flagpole holder of a metal golf cup.

A disadvantage of using metal golf cups and golf flagpole adapters made of a similar metal is that premature wear will occur. On occasions, especially when a new metal golf cup and a flagpole with a new adapter made of a similar metal are used, binding occurs. When a golfer or a caddy pulls out the flagpole, sometimes the entire flagpole together with the golf cup is pulled out from the hole.

Another disadvantage is that due to wearing of both the metal golf cup and the metal flagpole adapter, the conventional golf cups need to be replaced about every two years while the conventional flagpoles need to be replaced about every four years. Millions of these metal golf cups and flagpoles are being discarded to the dump every two years causing environment and disposal problems.

SUMMARY OF THE INVENTION

To at least partially overcome these disadvantages of the previous known golf cups and golf flagpoles, the present invention provides a golf cup with a replaceable bushing and a golf flagpole with a replaceable bushing to prevent premature wearing of the golf cup and the flagpole adapter, thereby prolonging the life span of the golf cup and the golf flagpole.

It is an object of the present invention to produce a metal golf cup with a replaceable plastic bushing to prevent premature wearing and to prolong the life span of the golf cup.

It is another object of the present invention to provide a golf flagpole with a replaceable plastic bushing to prevent premature wearing and to prolong the life span of the golf flagpole.

It is a further object of the present invention to reduce the expenses of the golf cups and golf flagpoles by providing replaceable parts rather than the need to replace the entire golf cups and golf flagpoles.

It is a further object of the present invention to make repairing and replacement of golf cups and flagpoles easy and convenient by having replacement parts readily available in stock at golf clubs.

According to one aspect of the invention, there is provided a golf cup comprising:

(a) a tubular housing;

(b) support members provided within said housing, said support members defining a central bore within said housing at a lower portion thereof;

(c) a bushing member, having an upper end and a lower end, are adapted to be snugly fitted in said central bore, the upper end of said bushing member having an annular flange adapted to engage with at least a shoulder of said support members at an upper end thereof for restricting downward movement of said bushing member, and the lower end of said bushing member being extended below a lower end of said support members and provided with an annular groove around an outer surface of said bushing member; and (d) a retaining member being fitted around said annular groove are adapted to be abutted against a bottom wall of said support members for restricting upward movement of said bushing member;

(e) wherein said bushing member is adapted to receive therein a golf flagpole adapter thereby holding a golf flagpole in an upright position.

According to another aspect of the invention, there is provided a golf cup comprising:

(a) an outer tubular housing having a concentric inner tubular member provided within said housing at a lower portion thereof;

(b) a plurality of rib members extending radially between said outer tubular housing and said inner tubular member;

(c) a tubular bushing member, having an upper end and a lower end, adapted to be snugly fitted against an inner wall of said inner tubular member, the upper end of said tubular bushing member having an annular flange adapted to engage with an annular shoulder of said inner tubular member at an upper end thereof for restricting downward movement of said tubular bushing member, and the lower end of said tubular bushing member being extended below a lower end of said inner tubular member and provided with an annular groove around an outer surface of said bushing member; and (d) an o-ring being fitted around said annular groove with protruded o-ring portion forming an annular ring adapted to be abutted against a bottom wall of said inner tubular member for restricting upward movement of said tubular bushing member;

(e) wherein said tubular bushing member is adapted to receive therein a golf flagpole adapter thereby holding a golf flagpole in an upright position.

According to a further aspect of the invention, there is provided a golf cup comprising:

(a) an outer tubular housing having a concentric inner tubular member provided within said housing at a lower portion thereof, (b) a plurality of rib members extending radially between said outer tubular housing and said inner tubular member;

(c) a tubular bushing member, having an upper end and a lower end, adapted to be snugly fitted against an inner wall of said inner tubular member, the upper end of said tubular bushing member having an annular flange adapted to engage with an annular shoulder of said inner tubular member at an upper end thereof for restricting downward movement of said tubular bushing member, and the lower end of said tubular bushing member being extended below a lower end of said inner tubular member and provided with an annular groove around an outer surface of said bushing member; and (d) a spring clip being fitted around said annular groove with protruding spring clip portions forming an annular ring adapted to be abutted against a bottom wall of said inner tubular member for restricting upward movement of said tubular bushing member;

(e) wherein said tubular bushing member is adapted to receive therein a golf flagpole adapter thereby holding a golf flagpole in an upright position.

According to another aspect of the invention, there is provided a golf cup comprising:

(a) an outer tubular housing;

(b) a plurality of generally horizontal and vertical support members extending radially inwardly towards a lower central portion of said tubular housing, and having free ends which define a cylindrical central bore;

(c) a tubular bushing member, having an upper end and a lower end, adapted to be snugly fitted in said cylindrical central bore, the upper end of said tubular bushing member having an annular flange adapted to support by shoulders formed by said horizontal and vertical support members at upper ends thereof for restricting downward movement of said tubular bushing member, and the lower end of said tubular bushing member being extended below said vertical support members and provided with an annular groove around an outer surface of said bushing member; and (d) an o-ring being fitted around said annular groove with protruded o-ring portion forming an annular ring adapted to be abutted against a bottom wall of said vertical support members for restricting upward movement of said tubular bushing member;

(e) wherein said tubular bushing member is adapted to receive therein a golf flagpole adapter thereby holding a golf flagpole in an upright position.

According to yet another aspect of the invention, there is provided a golf cup comprising:

(a) an outer tubular housing;

(b) a plurality of generally horizontal and vertical support members extending radially inwardly towards a lower central portion of said tubular housing, and having free ends which define a cylindrical central bore;

(c) a tubular bushing member, having an upper end and a lower end, adapted to be snugly fitted in said cylindrical central bore, the upper end of said tubular bushing member having an annular flange adapted to support by shoulders formed by said horizontal and vertical support members at upper ends thereof for restricting downward movement of said tubular bushing member, and the lower end of said tubular bushing member being extended below said vertical support members and provided with an annular groove around an outer surface of said bushing member; and (d) a spring clip being fitted around said annular groove with protruding spring clip portions forming an annular ring adapted to be abutted against a bottom wall of said vertical support members for restricting upward movement of said tubular bushing member;

(e) wherein said tubular bushing member is adapted to receive therein a golf flagpole adapter thereby holding a golf flagpole in an upright position.

According to yet another aspect of the invention, there is provided a bushing for use in a golf cup having an outer tubular housing, a plurality of support members, and a cylindrical central bore defined by said support members, said bushing comprising:

(a) a tubular body, having an upper end and a lower end, adapted to be snugly fitted in said cylindrical central bore; the upper end having an annular flange adapted to be supported by at least a shoulder of said support members for restricting downward movement of said bushing; the lower end being extended below said support members and provided with an annular groove around an outer surface of said bushing; and (b) a retaining member being fitted around said annular groove and adapted to be abutted against a bottom wall of said support members for restricting upward movement of said bushing;

(c) wherein said bushing is adapted to receive therein a golf flagpole adapter thereby holding a golf flagpole in an upright position.

According to another aspect of the invention, there is provided a golf cup having an outer tubular housing, a plurality of support members provided within said housing and defining a cylindrical central bore for receiving therein a fixed golf flagpole adapter with a bushing removeably provided thereon; said bushing having a sleeve body, an open end at one end of said sleeve body for receiving said fixed flagpole adapter, and a closed end at the other end of said sleeve body where said fixed flagpole adapter is fastened to said removeable bushing by a screw; wherein said golf cup and said fixed flagpole adapter are made of metal, and said bushing is made of plastic and is replaceable.

According to yet another aspect of the invention, there is provided a bushing for use with a golf flagpole, said bushing having an outer and tapered body and a retaining means for retaining said body to the base of an adapter at the bottom of said golf flagpole.

BRIEF DESCRIPTION OF THE DRAWINGS

Further aspects and advantages of the present invention will become apparent from the following description taken together with the accompanying drawings in which.

DETAILED DESCRIPTION OF THE INVENTION

Figure 1:
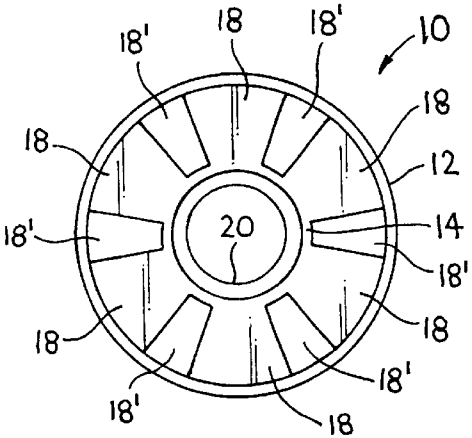
FIG. 1 is a plan view of a golf cup of the present invention.
Figure 2:
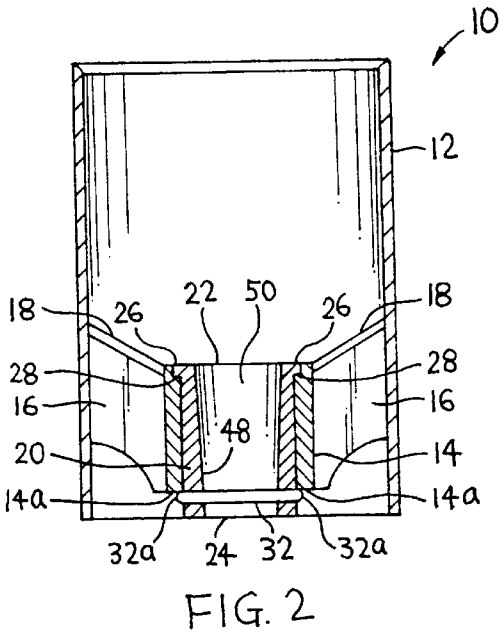
FIG. 2 is a vertical cross sectional view of the golf cup of FIG. 1.

Referring now in more detail to the drawings, in which like reference numerals represent like parts throughout the several views, FIGS. 1 and 2 show a plan view and a cross sectional view respectively of a golf cup in accordance with a preferred embodiment of the present invention. The golf cup is designated generally by reference numeral 10.

According to the preferred embodiment, the golf cup 10 has an outer tubular housing 12, and an inner flagpole holder or tubular member 14 is provided within the outer tubular housing 12 at a lower portion thereof. The outer tubular housing has a standard outer diameter and a standard height. A plurality of vertical support or rib members 16 extends between the inner surface of the outer tubular housing 12 and the outer surface of the inner tubular member 14. The plurality of vertical rib members 16 is employed to hold the inner tubular member 14 in position and for reinforcement purposes. A plurality of inclined support or rib members 18 extends between the inner surface of the outer tubular housing 12 and the outer surface of the inner tubular member 14. The plurality of inclined rib members 18 is employed to retain a golf ball dropped into the golf cup 10.

Reference to a "standard height" and a "standard diameter" refers to the standard dimensions established by the golfing association in whose jurisdiction the golf course is located.

A plurality of drainage slots 18' is provided between the plurality of inclined rib members 18. The drainage slots 18' facilitate the drainage of water, sand, and debris therethrough.

The outer tubular housing 12, the inner tubular member 14, the vertical rib member 16 and the inclined rib members 18 may be made of any suitable material. They may be made of various plastic materials as well as aluminum and other metal alloys including stainless steel.

According to an essential aspect of the present invention, a sleeve or tubular bushing member 20, made of plastic, is adapted to be press fitted into the inner tubular member 14, as shown in FIG. 2. The outer diameter of the tubular bushing member 20 is slightly less than the inner diameter of the inner tubular member 14 such that the tubular bushing member 20 can be fitted into the inner tubular member 14. The tubular bushing member 20 is applied to cover and prevent the metal inner tubular member 14 from wearing.

The tubular bushing member 20 has an upper end 22 and a lower end 24. An annular flange 26 is provided at the upper end 22 of the tubular bushing member 20. The annular flange 26 is adapted to be fitted on an annular shoulder 28 provided on an inner top edge of the inner tubular member 14. This holds the tubular bushing member 20 in a fixed position and prevents downward movement of the tubular bushing member 20 when a golf flagpole 34 is being inserted into the tubular bushing member 20 supported by the inner tubular member 14.

The words "upward", "downward", "vertical", and "horizontal" used in the specification refer to the directions or positions relative to a golf green surface.

Figure 3:
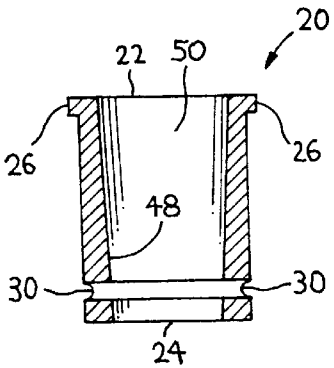
FIG. 3 is an enlarged cross sectional view of a replaceable bushing of the golf cup as shown in FIG. 2.

The lower end of the tubular bushing member 20 extends below the inner tubular member 14. As illustrated in FIG. 3, an annular groove 30 is provided on an outer surface proximate the lower end 24 of the tubular bushing member 20. The groove 30 has a C-shaped or semi-circular cross section. An o-ring 32 is adapted to fit around the annular groove 30, as shown in FIG. 2. The o-ring 32 protrudes from the outer surface of the tubular bushing member 20 forming an annular ring 32*a* disposed around the tubular bushing member 20 and abutted against an annular bottom wall 14*a* of the inner tubular member 14. This holds the tubular bushing member 20 in a fixed position and prevents upward movement of the tubular bushing member 20 when a golf flagpole 34 is being pulled away from the tubular bushing member 20.

Figure 7:
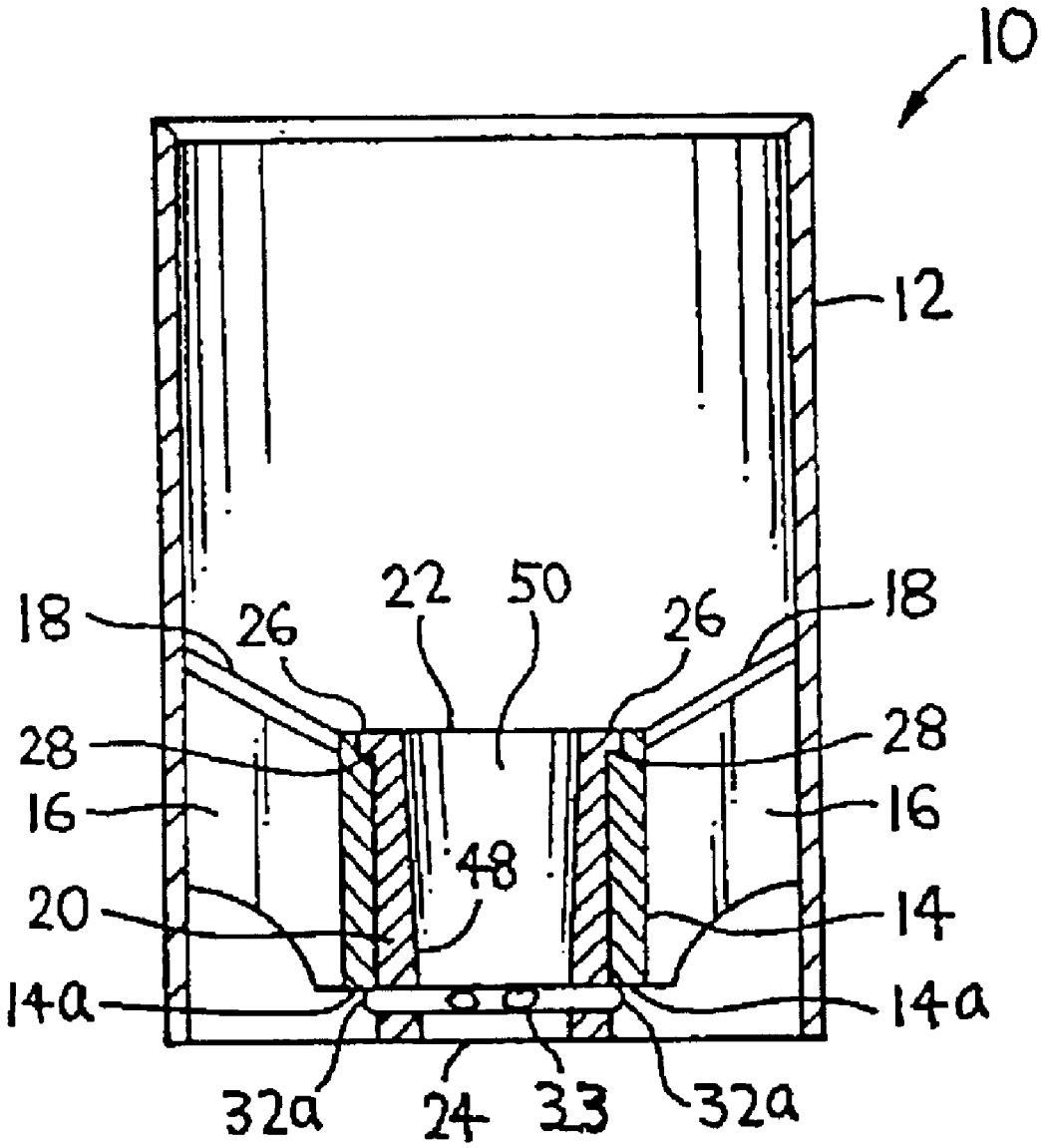
FIG. 7 is a vertical cross sectional view of a third embodiment of the golf cup of FIG. 1.

Other forms of retaining means may be used to secure the lower end of the bushing in place. For example, the o-ring 32 may be replaced by a spring clip 33 (see FIG. 7) which would be secured in the annular groove 30.

The tubular bushing member 20 has a standard inner diameter to receive therein a standard golf flagpole adapter.

Figure 5:
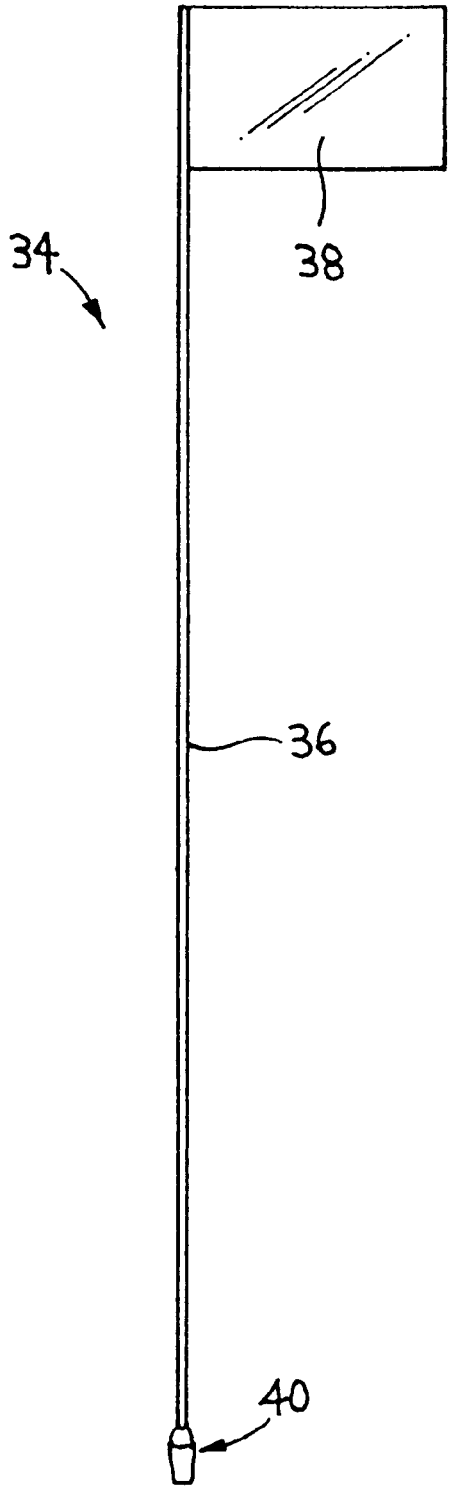
FIG. 5 is a golf flagpole.

FIG. 5 shows a golf flagpole 34 having, a pole 36, a flag 38 attached to an upper end of the pole 36, and an adapter, generally represented by reference numeral 40, attached to a lower end of the pole 36.

Figure 6:
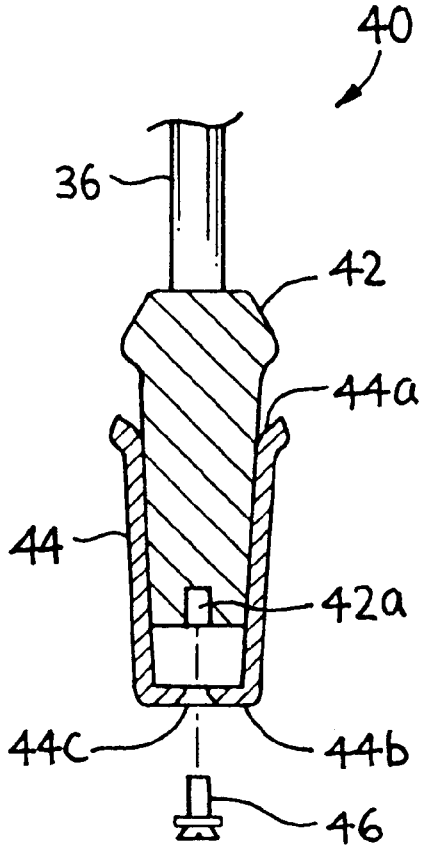
FIG. 6 is an enlarged cross sectional view of a lower end of the golf flagpole of FIG. 5 showing a fixed adapter and a replaceable bushing.

FIG. 6 is an enlarged view of the flagpole adapter 40. The flagpole adapter 40 has a fixed adapter 42 fixedly connected to the lower end of the pole 36. The fixed adapter 42 is usually made of metal. A sleeve bushing 44, made of plastic, has an open end 44*a*, a closed end 44*b*, and an opening 44*c* provided on the closed end 44*b*. The fixed adapter 42 is adapted to snugly fit into the plastic sleeve bushing 44 through the open end 44*a*. A screw 46 is used to fasten the plastic sleeve bushing 44 to the fixed adapter 42 by screwing through the opening 44*c* and into a threaded blind hole 42*a* provided at a bottom end of the metal adapter 42. The fixed adapter 42 has a tapering outer surface that matches a tapering inner surface 48 of the tubular bushing member 20. The plastic tubular bushing member 20 is applied to cover and prevent the metal fixed adapter 42 from wearing. The flagpole adapter 40 is adapted to be inserted into a central opening 50 defined by the tubular bushing member 20.

When the metal golf cup 10 with a plastic bushing member 20 shown in FIG. 2 is used in a golf green, the golf flagpole 34 to be inserted into the golf cup 10 can be a metal adapter 42 shown in FIG. 6. The plastic bushing member 20 facilitates the insertion and removal of the golf flagpole 34 into and from the golf cup 10 and prevents premature wearing of the metal golf cup 10 and the metal flagpole adapter 34.

However, in the case where a conventional metal golf cup without any plastic bushing 20 of the present invention is used, the metal golf flagpole adapter 42 to be inserted into the conventional metal golf cup can be provided with a plastic sleeve bushing 44 shown in FIG. 6. Similarly, the plastic sleeve bushing 44 facilitates the insertion and removal of the golf flagpole 34 into and from the golf cup 10 and prevents premature wearing of the metal golf cup 10 and the metal flagpole adapter 34.

It is also possible to machine existing flagpoles to adapt them for the present invention. Depending upon the existing structure, the base of the flagpole may be machined to a taper and a threaded hole drilled at its bottom and the bushing 44 placed thereon with the screw 46 accommodated in the drilled hole. Thus the invention is equally applicable to existing flagpoles.

It is understood that both the plastic golf cup tubular bushing 20 and the plastic golf flagpole sleeve bushing 44 can be used at the same time or individually.

Figure 4:
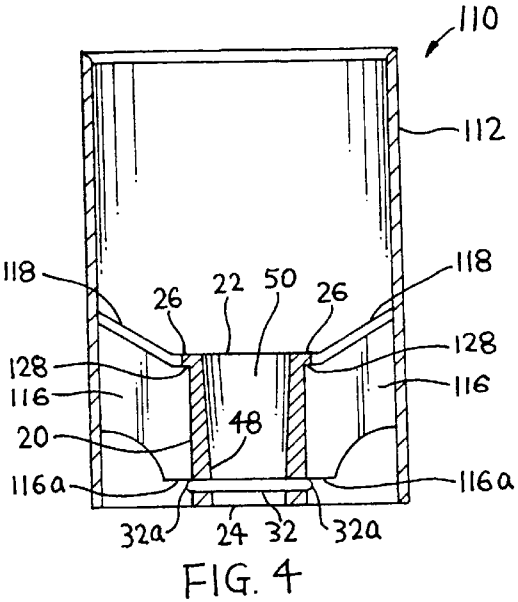
FIG. 4 is a vertical cross sectional view of a second embodiment of a golf cup of the present invention having a replaceable bushing shown in FIG. 3.

FIG. 4 is a cross sectional view similar to FIG. 2 showing a second embodiment of a golf cup generally designated by reference numeral 110. The golf cup 110 has an outer tubular housing 112 having a standard outer diameter and a standard height. A plurality of vertical support or rib members 116 extends inwardly from an inner surface of the outer tubular housing 112. The free ends of the plurality of vertical rib members 116 define a cylindrical central bore 150. The plurality of vertical rib members 116 is used for holding a golf flagpole 34. A plurality of inclined support or rib members 118 extends inwardly from the inner surface of the outer tubular housing 112 towards the cylindrical central bore 150. The plurality of inclined rib members 118 is employed to retain a golf ball dropped into the golf cup 110.

The outer tubular housing 112, the vertical rib members 116, and the inclined rib members 118 are preferably made of metal, though they can be made of plastic.

A plastic tubular bushing member 20, as described in the first embodiment, is adapted to be press fitted into the cylindrical central bore 50, as shown in FIG. 4. The outer surface of the tubular bushing member 20 is abutted against the free ends of the plurality of the vertical rib members 116. The tubular bushing member 20 has an upper end 22 and a lower end 24. An annular flange 26 is provided at the upper end 22 of the tubular bushing member 20. The annular flange 26 is adapted to be fitted on shoulders 128 provided on a top edge of the vertical rib members 116. This holds the tubular bushing member 20 in a fixed position and prevents downward movement of the tubular bushing member 20 when a golf flagpole 34 is being inserted into the tubular bushing member 20 being supported by the vertical rib members 116.

The lower end of the tubular bushing member 20 extends below the vertical rib members 116. An annular groove 30 is provided on an outer surface proximate the lower end of the tubular bushing member 20. The groove 30 has a C-shaped or semi-circular cross section. An o-ring 32 is adapted to fit around the annular groove 30. The o-ring 32 protrudes from the outer surface of the tubular bushing member 20 forming an annular ring 32*a* disposed around the tubular bushing member 20 and abutted against bottom surfaces 116*a* of the vertical rib members 116. This holds the tubular bushing member 20 in a fixed position and prevents upward movement of the tubular bushing member 20 when a flagpole 34 is being pulled away from the tubular bushing member 20.

Similarly, the tubular bushing member 20 has a tapering inner surface 48 for frictionally receiving therein a flagpole adapter 40 having a matching tapering outer surface.

It is appreciated that the majority of conventional metal or plastic golf cups cannot be redesigned to accommodate the plastic tubular bushing member 20 of the present invention whereas all flagpoles can be machined and retrofitted with the present invention. If a golf cup and a flagpole adapter are made of metal, then a replaceable plastic sleeve bushing can be incorporated into the flagpole in order to prevent premature wearing of the metal golf cup and the metal flagpole.

Therefore, if a metal golf cup is incorporated with a plastic bushing of the present invention, then the flagpole adapter can be made of metal without having a plastic bushing provided thereon. However, if a metal golf cup is a conventional golf cup without a plastic bushing of the present invention incorporated therewith, then the flagpole adapter should have a plastic bushing provided thereon.

In any case, it is understood that the inner diameter of the tubular bushing member 20 of the present invention, and the outer diameter of flagpole sleeve bushing 44 of the present invention should be made standard.

On a commercial level, a metal golf cup may be supplied with five replaceable plastic bushings which will prolong the life span of the golf cup from two years to ten years. A golf flagpole may be supplied with five plastic sleeve bushings which will prolong the life span of the flagpole from four years to twenty years. The cup bushing has a life span of two years and the flagpole bushing has an estimated life of about four years.

The plastic used for this invention may be any conventional plastic material and is preferably a very hard material such as a glass or mineral filled POLYPAD (trade mark), NYLON (trade mark), or a polyethylene. The cup is preferably made from a hard plastic material such as NORYL (trade mark) available from G. E. Polymer or ELF ATOCHEM KYNAR (trade mark). The cup is also preferably coated with a white paint or enamel as is presently done.

While the invention has been described to preferred embodiments, many modifications and variations will now occur to persons skilled in the art. For a definition of the invention, reference is made to the appended claims.

What is claimed is:

1. A golf cup comprising:

(a) a tubular housing;

(b) support members provided within said housing, said support members defining a central bore within said housing at a lower portion thereof;

(c) a bushing member, having an upper end and a lower end, adapted to be snugly fitted in said central bore, the upper end of said bushing member having an annular flange adapted to engage with at least a shoulder of said support members at an upper end thereof for restricting downward movement of said bushing member, and the lower end of said bushing member being extended below a lower end of said support members and provided with an annular groove around an outer surface of said bushing member; and (d) a retaining member being fitted around said annular groove are adapted to be abutted against a bottom wall of said support members for restricting upward movement of said bushing member;

(e) wherein said bushing member is adapted to receive therein a golf flagpole adapter thereby holding a golf flagpole in an upright position.

2. A golf cup as claimed in claim 1 wherein said bushing member has a tapering inner surface for frictionally receiving therein said golf flagpole adapter.

3. A golf cup as claimed in claim 1 wherein said tubular housing and said support members are made of metal; and said bushing member is made of plastic and is replaceable.

4. A golf cup as claimed in claim 1 wherein said retaining member is an o-ring being fined around said annular groove with a protruding o-ring portion forming an annular ring and which is adapted to be abutted against a bottom wall of said support members for restricting upward movement of said bushing member.

5. A golf cup as claimed in claim 1 wherein said retaining member is a spring clip fitted around said annular groove and adapted to be abutted against a bottom wall of said support members for restricting upward movement of said bushing member.

6. A golf cup comprising:

(a) an outer tubular housing having a concentric inner tubular member provided within said housing at a lower portion thereof;

(b) a plurality of rib members extending radially between said outer tubular housing and said inner tubular member;

(c) a tubular bushing member, having an upper end and a lower end, adapted to be snugly fitted against an inner wall of said inner tubular member, the upper end of said tubular bushing member having an annular flange adapted to engage with an annular shoulder of said inner tubular member at an upper end thereof for restricting downward movement of said tubular bushing member, and the lower end of said tubular bushing member being extended below a lower end of said inner tubular member and provided with an annular groove around an outer surface of said bushing member; and (d) an o-ring being fitted around said annular groove with a protruded o-ring portion forming an annular ring adapted to be abutted against a bottom wall of said inner tubular member for restricting upward movement of said tubular bushing member;

(e) wherein said tubular bushing member is adapted to receive therein a golf flagpole adapter thereby holding a golf flagpole in an upright position.

7. A golf cup comprising:

(a) an outer tubular housing having a concentric inner tubular member provided within said housing at a lower portion thereof;

(b) a plurality of rib members extending radially between said outer tubular housing and said inner tubular member;

(c) a tubular bushing member, having an upper end and a lower end, adapted to be snugly fitted against an inner wall of said inner tubular member, the upper end of said tubular bushing member having an annular flange adapted to engage with an annular shoulder of said inner tubular member at an upper end thereof for restricting downward movement of said tubular bushing member, and the lower end of said tubular bushing member being extended below a lower end of said inner tubular member and provided with an annular groove around an outer surface of said bushing member; and (d) a spring clip being fitted around said annular groove with protruding spring clip portions forming an annular ring adapted to be abutted against a bottom wall of said inner tubular member for restricting upward movement of said tubular bushing member;

(e) wherein said tubular bushing member is adapted to receive therein a golf flagpole adapter thereby holding a golf flagpole in an upright position.

8. A golf cup comprising:

(a) an outer tubular housing;

(b) a plurality of generally horizontal and vertical support members extending radially inwardly towards a lower central portion of said tubular housing, and having free ends which define a cylindrical central bore;

(c) a tubular bushing member, having an upper end and a lower end, adapted to be snugly fitted in said cylindrical central bore, the upper end of said tubular bushing member having an annular flange adapted to support by shoulders formed by said horizontal and vertical support members at upper ends thereof for restricting downward movement of said tubular bushing member, and the lower end of said tubular bushing member being extended below said vertical support members and provided with an annular groove around an outer surface of said bushing member; and (d) an O-ring being fitted around said annular groove with protruded o-ring portion forming an annular ring adapted to be abutted against a bottom wall of said vertical support members for restricting upward movement of said tubular bushing member;

(e) wherein said tubular bushing member is adapted to receive therein a golf flagpole adapter thereby holding a golf flagpole in an upright position.

9. A golf cup comprising:

(a) an outer tubular housing;

(b) a plurality of generally horizontal and vertical support members extending radially inwardly towards a lower central portion of said tubular housing, and having free ends which define a cylindrical central bore;

(c) a tubular bushing member, having an upper end and a lower end, adapted to be snugly fitted in said cylindrical central bore, the upper end of said tubular bushing member having an annular flange adapted to support by shoulders formed by said horizontal and vertical support members at upper ends thereof for restricting downward movement of said tubular bushing member, and the lower end of said tubular bushing member being extended below said vertical support members and provided with an annular groove around an outer surface of said bushing member; and (d) a spring clip being fitted around said annular groove with protruding spring clip portions forming an annular ring adapted to be abutted against a bottom wall of said vertical support members for restricting upward movement of said tubular bushing member;

(e) wherein said tubular bushing member is adapted to receive therein a golf flagpole adapter thereby holding a golf flagpole in an upright position.

10. A bushing adapted for use in a golf cup, said golf cup comprising an outer tubular housing, a plurality of support members and a cylindrical central bore defined by said support members, said bushing comprising:

(a) a tubular body having an upper end and a lower end, adapted to be snugly fitted in said cylindrical central bore, the upper end of said body having an annular flange adapted to be supported by at least a shoulder of said support members for restricting downward movement of said bushing, the lower end of said body being extended below said support members and provided with an annular groove around an outer surface of said bushing; and (b) a retaining member being fitted around said annular groove and adapted to be abutted against a bottom wall of said support members for restricting upward movement of said bushing;

(c) wherein said bushing is adapted to receive therein a golf flagpole adapter thereby holding a golf flagpole in an upright position.

11. A bushing as claimed in claim 10 wherein said retaining member is an o-ring being fitted around said annular groove with protruding O-ring portions forming an annular ring and adapted to be abutted against a bottom wall of said support members for restricting upward movement of said bushing.

12. A bushing as claimed in claim 10 wherein said retaining member is a spring clip being fitted around said annular groove with protruding spring clip portions forming an annular ring and adapted to be abutted against a bottom wall of said support members for restricting upward movement of said bushing.

13. A bushing as claimed in claim 10 wherein said tubular body of said bushing has a tapering inner surface for frictionally receiving therein said golf flagpole adapter having a matching tapering outer surface.

14. A bushing as claimed in claim 10 wherein said outer tubular housing, said plurality of support members, and said golf flagpole adapter are made of metal; whereas said bushing is made of plastic and is adapted to be replaceable.

15. A bushing as claimed in claim 10 wherein said annular groove has a semi-circular cross section.

16. A bushing as claimed in claim 11 wherein said o-ring is made of resilient material.

* * * * *